US009308531B2

(12) United States Patent
Hasegawa et al.

(10) Patent No.: US 9,308,531 B2
(45) Date of Patent: Apr. 12, 2016

(54) REAGENT SET AND REAGENT CONTAINER PACKING BOX

(71) Applicant: Sysmex Corporation, Kobe-shi, Hyogo (JP)

(72) Inventors: Fuminari Hasegawa, Kobe (JP); Hiroyuki Ohashi, Kobe (JP); Shuji Nagai, Mundelein, IL (US); Ryo Ookubo, Fuchu (JP); Yasuhiro Yamamoto, Fuchu (JP)

(73) Assignee: SYSMEX CORPORATION, Kobe (JP)

( * ) Notice: Subject to any disclaimer, the term of this patent is extended or adjusted under 35 U.S.C. 154(b) by 0 days.

(21) Appl. No.: 14/522,123

(22) Filed: Oct. 23, 2014

(65) Prior Publication Data

US 2015/0118125 A1 Apr. 30, 2015

(30) Foreign Application Priority Data

Oct. 25, 2013 (JP) ..... 2013-221894

(51) Int. Cl.
*B01L 3/00* (2006.01)
*B65D 25/04* (2006.01)
*B65D 77/04* (2006.01)

(52) U.S. Cl.
CPC ..... *B01L 3/523* (2013.01); *B01L 3/527* (2013.01); *B65D 77/0426* (2013.01); *B01L 2200/026* (2013.01); *B01L 2300/048* (2013.01)

(58) Field of Classification Search
CPC ..... B01L 3/52; B65D 25/04; B65D 5/46184; B65D 5/5045; B65D 5/48004; B65D 5/5014
USPC ..... 422/430
See application file for complete search history.

(56) References Cited

U.S. PATENT DOCUMENTS

| | | | | | |
|---|---|---|---|---|---|
| 5,996,804 | A * | 12/1999 | Kuhn | B65D 5/5014 206/193 |
| 6,129,211 | A * | 10/2000 | Prakken et al. | 206/750 |
| 8,679,425 | B2 | 3/2014 | Ueda et al. | |
| 2011/0014095 | A1 * | 1/2011 | Ueda | B01L 3/0293 422/429 |

FOREIGN PATENT DOCUMENTS

| | | | |
|---|---|---|---|
| JP | 2-63320 U | | 5/1990 |
| JP | 2002-205766 A | | 7/2002 |
| JP | 2008-239171 A | | 10/2008 |
| JP | 2008239171 | * | 10/2008 |
| JP | 2010-83532 A | | 4/2010 |

* cited by examiner

*Primary Examiner* — Jill Warden
*Assistant Examiner* — Jacqueline Brazin
(74) *Attorney, Agent, or Firm* — Brinks Gilson & Lione

(57) ABSTRACT

Disclosed is a reagent set, including a boxy body; an internal holding member arranged in the box body to form a container accommodating region in the box body; and a reagent container, arranged in the container accommodating region, and including a main body portion and a mouth portion formed on an upper surface of the main body portion.

23 Claims, 14 Drawing Sheets

REAGENT SET AND REAGENT CONTAINER PACKING BOX

RELATED APPLICATIONS

This application claims priority under 35 U.S.C. §119 to Japanese Patent Application No. 2013-221894 filed on Oct. 25, 2013, the entire content of which is hereby incorporated by reference.

TECHNICAL FIELD

The present invention relates to a reagent set and a reagent container packing box.

BACKGROUND OF THE INVENTION

Various packing boxes for transporting and storing a reagent container containing a reagent to use for an analyzer, and the like have been proposed. A reagent container filled with reagent and an empty drainage container containing drainage from the analyzer are accommodated in a packing box as a set (see for example U.S. Pat. No. 8,679,425).

In the technology described in U.S. Pat. No. 8,679,425, the reagent container filled with reagent and the drainage container inflated by sealing gas are inserted into a box main body, and thereafter, a container holding member is arranged in the box main body, and a flange-shaped lock portion on a lower side of a mouth portion of each container is locked to a circumferential edge of a holding hole formed at an upper surface part of the container holding member. In this case, the mouth portion of the container needs to be pulled out from the holding hole using fingers, which is a troublesome task. The mouth portion can be easily pulled out by enlarging the holding hole, but in this case, a gap between the holding hole and the mouth portion becomes too large and the container cannot be stably positioned.

SUMMARY OF THE INVENTION

The scope of the present invention is defined solely by the appended claims, and is not affected to any degree by the statements within this summary.

A reagent set of the present invention includes a box body; an internal holding member arranged in the box body to form a container accommodating region in the box body; and at least one reagent container arranged in the container accommodating region; where the internal holding member includes a plurality of side surface portions, and a pair of top plate portions, respectively extending from the opposing side surface portions of the plurality of side surface portions to cover an opening formed by the side surface portions; each of the pair of top plate portions is formed, at an end, with a positioning section for positioning a mouth portion of the reagent container; and the mouth portion of the reagent container arranged in the container accommodating region is positioned by the positioning section by covering the opening formed by the side surface portions with the pair of top plate portions.

A reagent container packing box of the present invention includes a box body; and an internal holding member arranged in the box body to form a container accommodating region in the box body; where the internal holding member includes a plurality of side surface portions, and a pair of top plate portions, respectively extending from the opposing side surface portions of the plurality of side surface portions to cover an opening formed by the side surface portions; each of the pair of top plate portions is formed, at an end, with a positioning section for positioning a mouth portion of the reagent container; and the mouth portion of the reagent container arranged in the container accommodating region is positioned by the positioning section by covering the opening with the pair of top plate portions.

DETAILED DESCRIPTION OF THE PREFERRED EMBODIMENTS

An embodiment of a reagent set and a reagent container packing box will be hereinafter described in detail with reference to the accompanying drawings.

[Overall Configuration of Reagent Set]

First, an overall configuration of a reagent set will be described.

Figure 1:
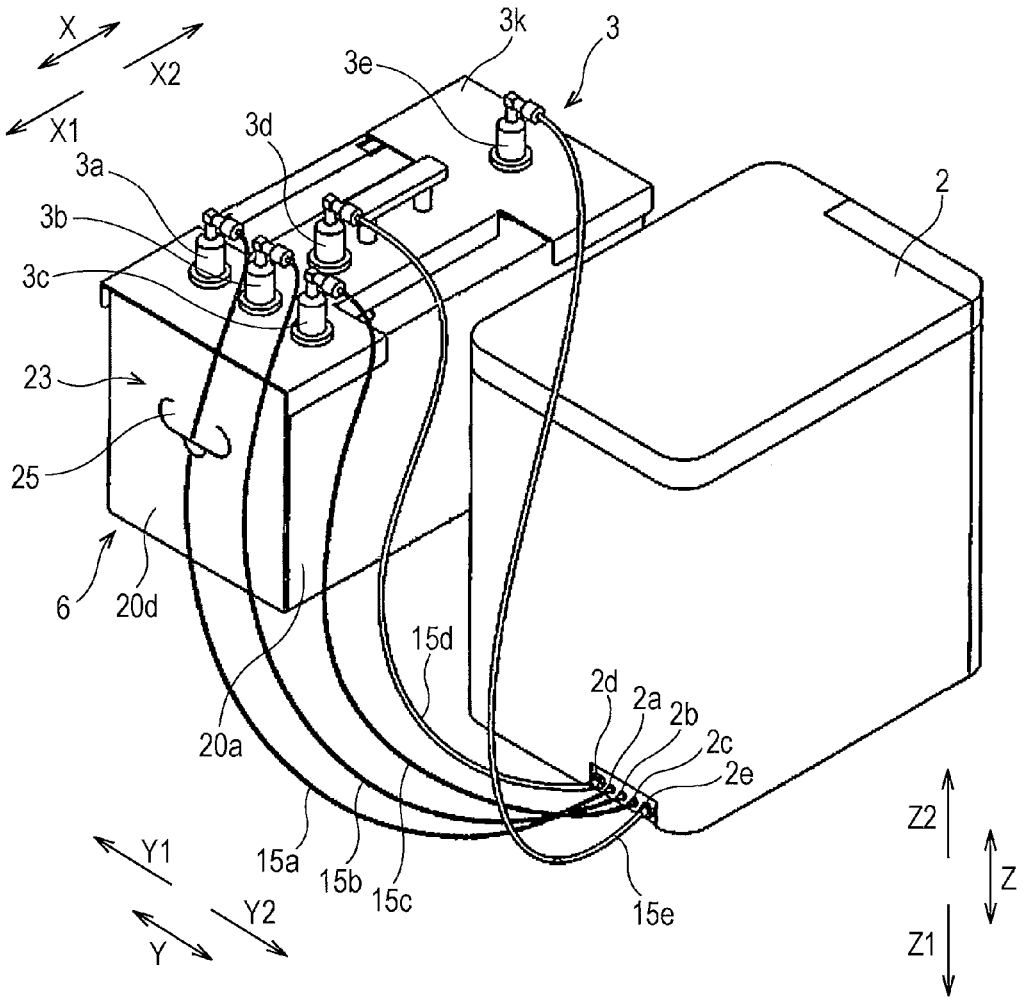
FIG. 1 is a perspective explanatory view showing a configuration of one embodiment of a reagent set of the present invention, a sample analyzer and a reagent take-out member.
Figure 2:
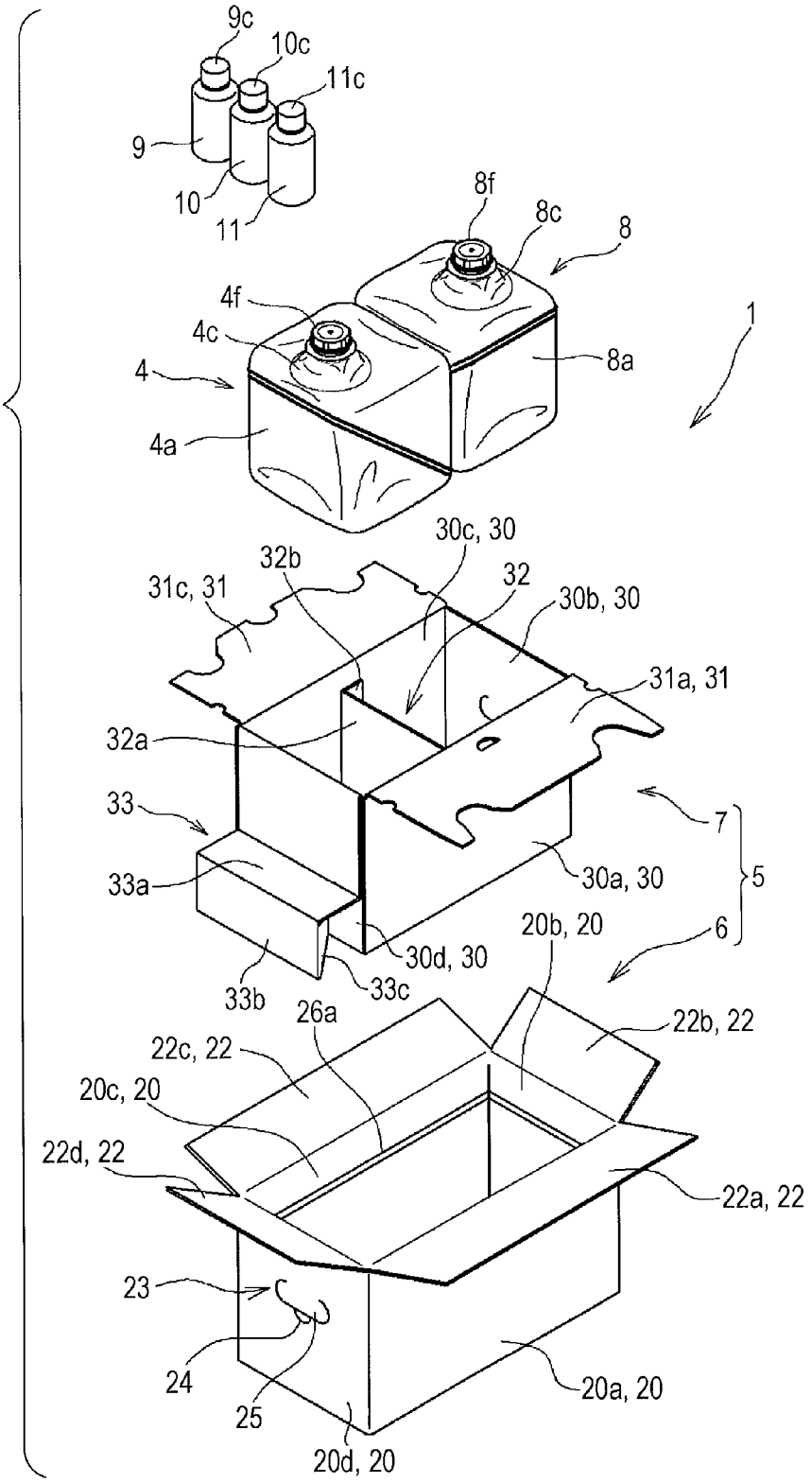
FIG. 2 is an exploded perspective view showing an overall configuration of the reagent set shown in FIG. 1.

As shown in FIGS. 1 and 2, a reagent set 1 according to the present embodiment is mainly configured by a diluted solution container 4, which is a reagent container, and a reagent container packing box 5 that accommodates the diluted solution container 4. The reagent container packing box 5 includes a box body 6 and an internal holding member 7. The reagent set 1 includes a drainage container 8 and three bottle-shaped containing containers 9, 10, 11 in addition to the diluted solution container 4 and the reagent container packing box 5. As shown in FIG. 1, the reagent set 1 is connected to a sample analyzer 2 (in the present embodiment, blood cell counting device that counts blood cells in the blood) for analyzing blood by way of a reagent take-out member 3 with a lid portion of the box body 6 cut off. Hereinafter, each constituent will be described in detail.

In the present specification, the term "container" is a concept that not only includes a reagent container containing reagent, but also containers such as a container containing various types of fluids other than the reagent used in the sample analyzer, a drainage container 8 containing fluid discharged from the sample analyzer. Therefore, other containers such as the drainage container may be accommodated other than the reagent container in the "container accommodating region".

[Box Body]

Figure 6:
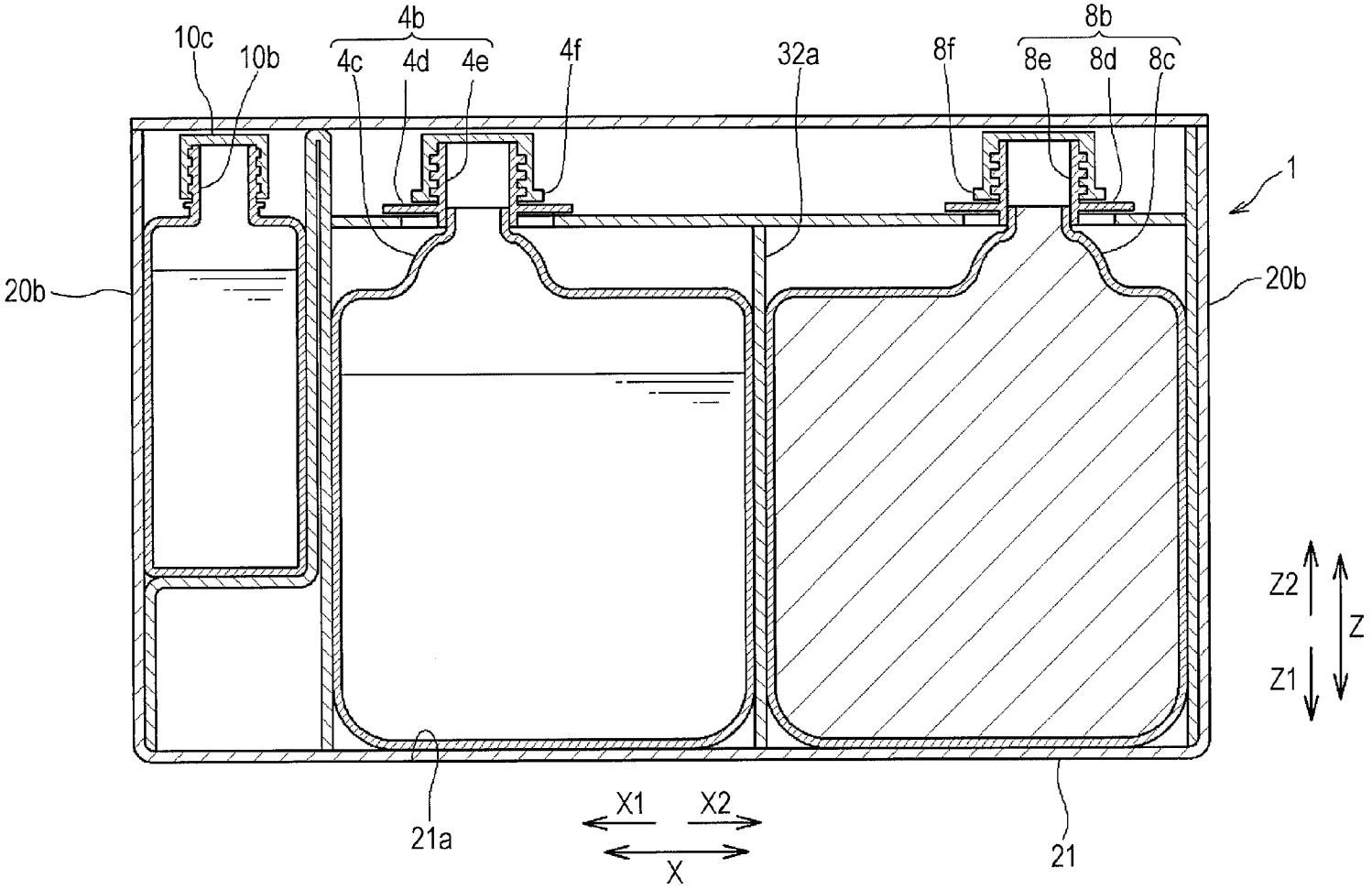
FIG. 6 is a cross-sectional explanatory view taken along line A-A of FIG. 3.

As shown in FIGS. 1, 2, and 6, the box body 6 has a cuboid shape including four side surface portions 20*a*, 20*b*, 20*c*, and 20*d*, a bottom portion 21, and a lid portion 22, and interiorly has a space for accommodating the diluted solution container 4, and the like. The side surface portion 20*a* and the side surface portion 20*c* are formed in the direction of an arrow Y2 and in the direction of an arrow Y1, respectively. The side surface portion 20*b* and the side surface portion 20*d* are formed in the direction of an arrow X2 and in the direction of an arrow X1, respectively. The arrow Y2 and the arrow Y1 are arrows extending in a short-side direction (Y direction in FIG. 1) of the box body 6, and the arrow X2 and the arrow X1 are arrows extending in a longitudinal direction (X direction in FIG. 1) of the box body 6. At substantially a central part of the side surface portion 20*b* and the side surface portion 20*d* is formed a handgrip forming section 23 for forming a handgrip to use for carrying of the box body 6. The handgrip forming section 23 has an oval shape, and at a central part of the lower end thereof is formed a cutoff piece 24 that when pushed by the user with a finger can easily form a semicircular opening. A cutoff portion is formed at one part (portion shown as a C-shape with a solid line in FIG. 3) of a peripheral edge of the handgrip forming section 23, where a handgrip section 25 can be formed by pushing in the cutoff piece 24 toward the interior side of the box body 6, pinching the handgrip forming section 23 with fingers, and spreading the handgrip forming section 23 toward the outer side with the upper end as a supporting point. A pinching section 26 that configures a part of an opening means (means for cutting off the lid portion 22 of the box body 6 to open the box body 6), to be described later, is formed at a central part of the upper part of the side surface portion 20*b* and the side surface portion 20*d*.

The lid portion 22 is configured by a pair of lid portion pieces 22*a*, 22*c* respectively extending from one opposing side surface portions 20*a*, 20*c*, and a pair of second lid portion pieces 22*b*, 22*d* respectively extending from the other opposing side surface portions 20*b*, 20*d*. An upper opening of the box body 6 can be closed by the four lid portion pieces. The upper opening can be maintained in a closed state using an adhesive tape, an adhesive, and the like so that the four lid portion pieces do not open.

Although not shown, the bottom portion 21 is also configured by a pair of bottom portion pieces respectively extending from one opposing side surface portions 20*a*, 20*c*, and a pair of second bottom portion pieces respectively extending from the other opposing side surface portions 20*b*, 20*d*, similar to the lid portion 22. A lower opening of the box body 6 can be closed by the four bottom portion pieces. The lower opening can also be maintained in a closed state using an adhesive tape, an adhesive, and the like so that the four bottom portion pieces do not open. The lid portion 22 is configured such that the first lid portion pieces 22*a*, 22*c* cover the second lid portion pieces 22*b*, 22*d* folded toward the inner side, and the bottom portion 21 is also similarly configured such that the first bottom portion pieces cover the second bottom portion pieces folded toward the inner side, whereby the strength of the box body 6 can be enhanced.

The box body 6 can be produced through a general production method using a cardboard, for example. When using a cardboard, the thickness is not particularly limited but is normally about 3 mm to 10 mm. Various dimensions (height, width, depth) of the box body 6 can be appropriately selected according to the dimension of the container scheduled to accommodate. For example, in FIG. 3, the dimension in the X direction may be about 400 mm, the dimension in the Y direction may be about 200 mm, and the dimension in the Z direction may be about 250 mm.

[Container]

In the reagent set 1 according to the present embodiment, the diluted solution container 4, the drainage container 8, a hemolytic agent containing container 9, a hemolytic agent containing container 10, and a stain containing container 11 are accommodated in the box body 6. During the use of the reagent set 1, such containers are used while being arranged at a predetermined place without being taken out from the box body 6.

<Diluted Solution Container, Drainage Container>

Figure 8:
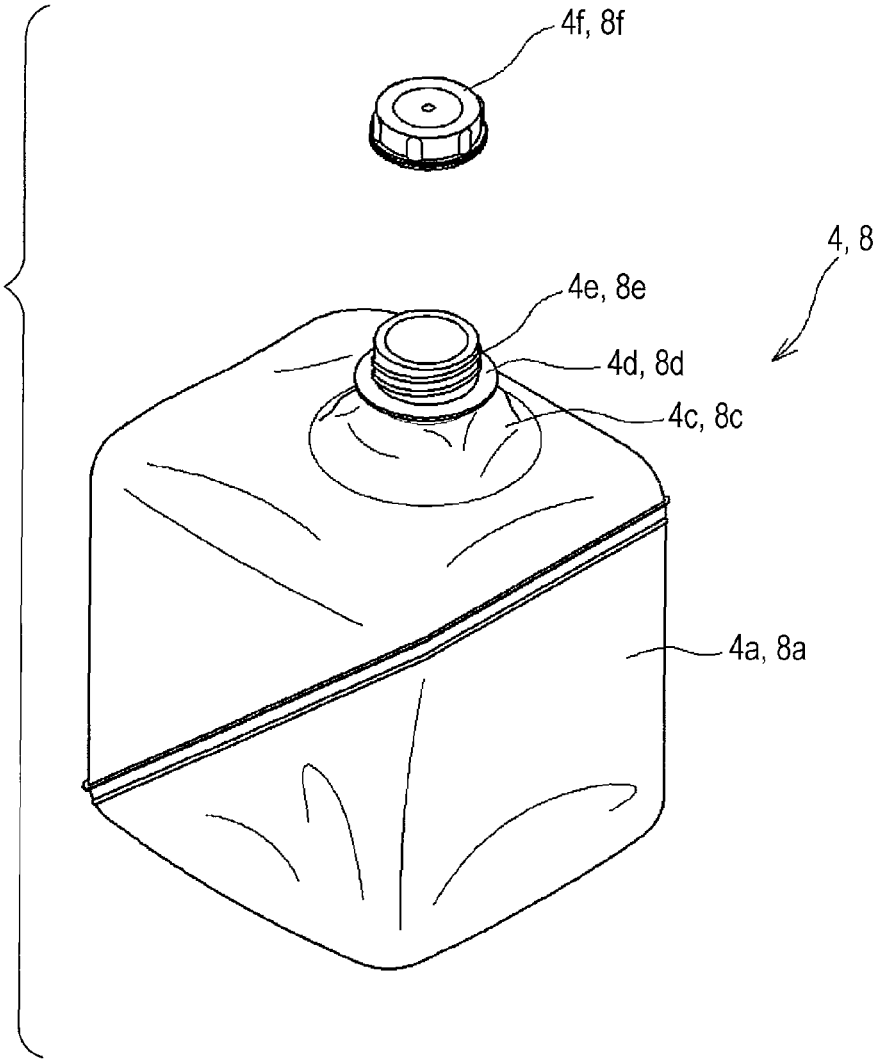
FIG. 8 is a perspective explanatory view showing a diluted solution container or a drainage container of the reagent set shown in FIG. 2.

As shown in FIGS. 2 and 8, the diluted solution container 4 and the drainage container 8 are made from substantially the same container, and both have a substantially cube shape. The diluted solution container 4 includes a main body portion 4*a* where the diluted solution is contained, and a projecting portion 4*b* formed on an upper surface (surface in a direction of an arrow Z2) of the main body portion 4*a*. The drainage container 8 includes a main body portion 8*a* to where the drainage is collected, and a projecting portion 8*b* formed on an upper surface (surface in the direction of the arrow Z2) of the main body portion 8*a*. The main body portion 4*a* of the diluted solution container 4 and the main body portion 8*a* of the drainage container 8 are made from a synthetic resin having flexibility to the extent in which the shape can be changed in some measure. Therefore, the main body portions 4*a*, 8*a* can take a form of being deflated and folded, or a form of being inflated to a substantially cube shape. As shown in FIG. 6, bottom portions (in a direction of an arrow Z1) of the main body portions 4*a*, 8*a* are supported by an inner side surface (bottom surface) 21*a* of the bottom portion 21 of the box body 6. In other words, the diluted solution container 4 and the drainage container 8 are arranged in the box body 6 at substantially the same height.

As shown in FIG. 8, the projecting portion 4*b* of the diluted solution container 4 includes a boundary portion 4*c* positioned at a boundary with the upper surface of the main body portion 4*a*, a tubular mouth portion 4*e* formed at an upper part of the boundary portion 4*c*, and a flange-shaped lock portion 4*d* formed at a lower end (boundary portion 4*c* side) of the mouth portion 4*e*. Similarly, the projecting portion 8*b* of the drainage container 8 includes a boundary portion 8*c* positioned at a boundary with the upper surface of the main body portion 8*a*, a tubular mouth portion 8*e* formed at an upper part of the boundary portion 8*c*, and a flange-shaped lock portion 8*d* formed at a lower end (boundary portion 8*c* side) of the mouth portion 8*e*. In the present embodiment, the boundary portions 4*c* and 8*c* have flexibility, and are configured to project out slightly to the upper side when stretched upward (direction of the arrow Z2) by the user. The lock portions 4*d* and 8*d* are respectively configured to lock to cutout portions 31*a*6 and 31*c*4 of the internal holding member 7, to be described later. The shape and dimension of the lock portions 4*d* and 8*d* are not particularly limited, but are formed to a brim shape or a flange shape having a diameter of about 60 mm and a thickness of about 2 mm in the present embodiment.

The mouth portions 4*e* and 8*e* are formed at substantially the center of the projecting portions 4*b* and 8*b*, respectively, when seen from the upper side. Before use and after use of the reagent set 1, the mouth portions 4*e* and 8*e* are sealed by being screw-fitted with caps 4*f* and 8*f*, respectively.

As shown in FIG. 6, in a state before use of the reagent set 1, the diluted solution is contained in the diluted solution container 4, and the mouth portion 4*e* is sealed by the cap 4*f*. In a state before use of the reagent set 1, the mouth portion 8*e* is sealed by the cap 8*f* with gas (indicated with diagonal lines in FIG. 6) sealed in the main body portion 8*a* of the drainage container 8. The sealed gas enables the drainage container 8 to be held to a substantially cube shape. The gas is not sealed to an extent of completely expanding the main body portion 8*a* of the drainage container 8 to prevent rupture of the main body portion 8*a* of the drainage container 8. In the present embodiment, air is sealed in as the gas, but other gases such as nitrogen gas may be sealed in.

The mouth portions 4*e* and 8*e* are respectively configured so that a reagent aspirating tube 3*f* and a drainage discharging tube 3*j* (see FIG. 7) of the reagent take-out member 3 can be inserted. The mouth portion 4*e* of the diluted solution container 4 is configured so that the diluted solution contained in the main body portion 4*a* can be taken out by the sample analyzer 2 through a reagent take-out portion 3*d* and a tube 15*d*. The mouth portion 8*e* of the drainage container 8 is configured so that the drainage can flow in from the sample analyzer 2 through a tube 15*e* and a drainage discharging portion 3*e*. The mouth portion 8*e* is also configured so as to also be used as a discharge port for discharging the drainage to the outside when the drainage is contained in the main body portion 8*a*.

The diluted solution container 4 is arranged at substantially the central part in the X direction in the interior of the box body 6, and the drainage container 8 is arranged in a direction of the arrow X2 in the interior of the box body 6. Thus, the diluted solution container 4 is arranged so as to be sandwiched in the X direction by a supporting section 33, to be described later, of the internal holding member 7 arranged in the direction of the arrow X1 and the drainage container 8 arranged in the direction of the arrow X2.

<Hemolytic Agent Containing Container, Stain Containing Container>

Figure 9:
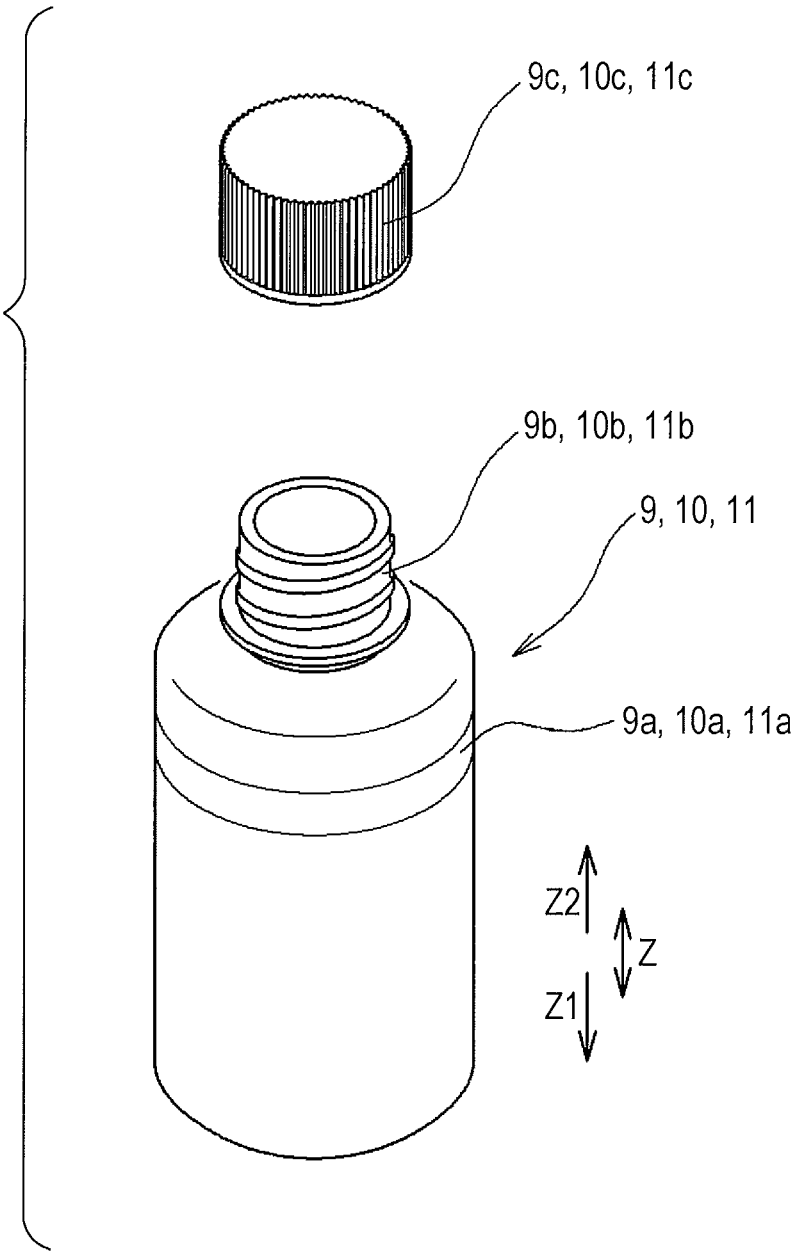
FIG. 9 is a perspective explanatory view showing a hemolytic agent containing container or a stain containing container of the reagent set shown in FIG. 2.

As shown in FIG. 9, the hemolytic agent containing container 9, the hemolytic agent containing container 10, and the stain containing container 11 all have the same bottle shape. The hemolytic agent containing container 9, the hemolytic agent containing container 10, and the stain containing container 11 are made from a hard synthetic resin such as polyethylene, polypropylene, and the like. The hemolytic agent containing container 9 contains hemolytic agent for hemoglobin measurement as a reagent, the hemolytic agent containing container 10 contains hemolytic agent for white blood cell classification and measurement as a reagent, and the stain containing container 11 contains stain for reticulocyte measurement as a reagent. The inner capacity of the hemolytic agent containing container 9, the hemolytic agent containing container 10, and the stain containing container 11 is not particularly limited. The inner capacity thereof can be appropriately selected according to the scale of the analyzer, and the like. In the present embodiment, the hemolytic agent containing container 9, the hemolytic agent containing container 10, and the stain containing container 11 are respectively configured to contain about 250 mL of fluid.

As shown in FIG. 2, the hemolytic agent containing container 9, the hemolytic agent containing container 10, and the stain containing container 11 are sequentially arranged from the direction of the arrow Y1 toward the direction of the arrow Y2. In order to easily distinguish each containing container, a blue identification label 9*a* is provided on a side surface of the hemolytic agent containing container 9, a green identification label 10*a* is provided on a side surface of the hemolytic agent containing container 10, and a red identification label 11*a* is provided on a side surface of the stain containing container 11.

Figure 7:
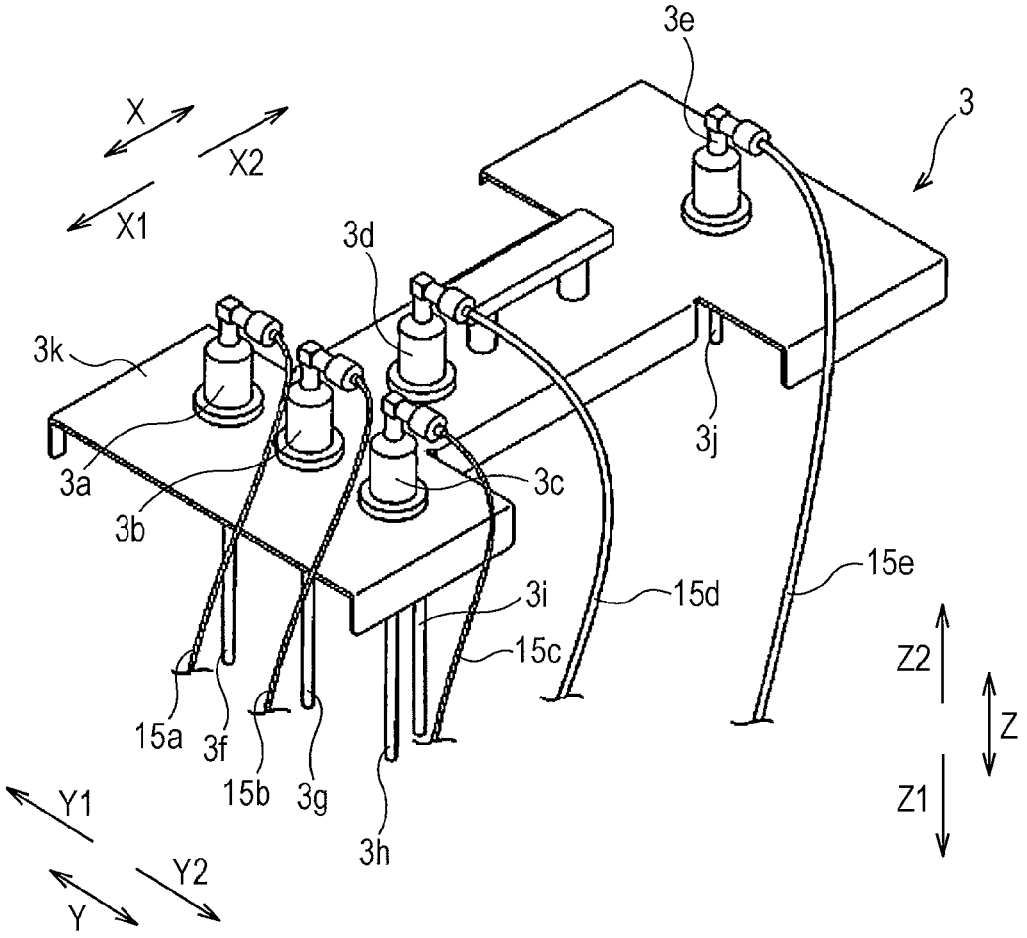
FIG. 7 is a perspective explanatory view of one example of the reagent take-out member used with the reagent set shown in FIG. 4.

As shown in FIG. 9, mouth portions 9*b*, 10*b*, and 11*b* are formed at the respective upper parts of the hemolytic agent containing container 9, the hemolytic agent containing container 10, and the stain containing container 11. The reagent aspirating tubes 3*f*, 3*g*, and 3*h* of the reagent take-out member 3 shown in FIG. 7 are inserted to the mouth portions 9*b*, 10*b*, and 11*b*, respectively. Thus, as shown in FIG. 1, the reagents contained in the hemolytic agent containing container 9, the hemolytic agent containing container 10, and the stain containing container 11 are respectively taken out by the sample analyzer 2 through reagent take-out portions 3*a*, 3*b*, and 3*c* of the reagent take-out member 3 and the tubes 15*a*, 15*b*, and 15*c*. Before use and after use of the reagent set 1, the mouth portions 9*b*, 10*b*, and 11*b* are each sealed by being screw-fitted with caps 9*c*, 10*c*, and 11*c*, as shown in FIG. 9.

The hemolytic agent containing container 9, the hemolytic agent containing container 10, and the stain containing container 11 are arranged on the supporting section 33, to be described later, of the internal holding member 7.

[Internal Holding Member]

Figure 10:
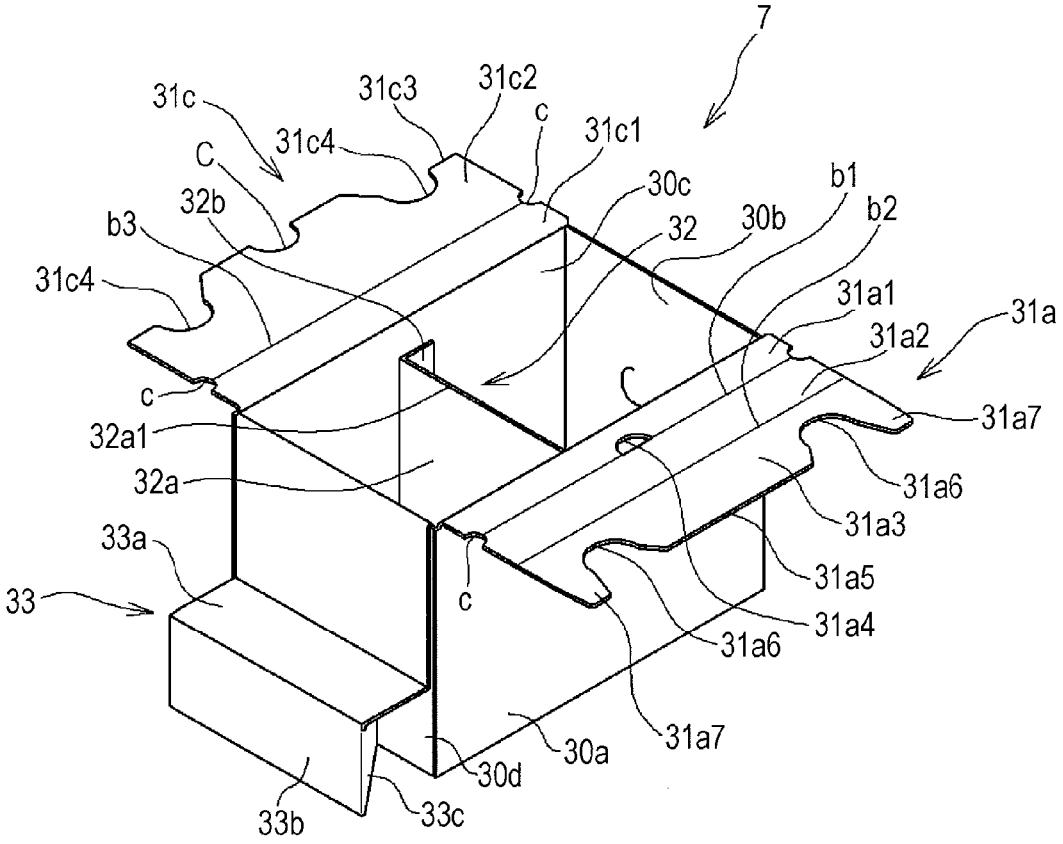
FIG. 10 is a perspective explanatory view of an internal holding member.

The internal holding member 7 is arranged in the box body 6, and forms a container accommodating region for arranging at least one (two in the present embodiment) container in the box body 6. The internal holding member 7 is a member for positioning the previously described various types of containers to be accommodated in the box body 6. As shown in FIGS. 2 and 10, the internal holding member 7 includes four side surface portions 30*a*, 30*b*, 30*c*, and 30*d*, and a pair of top plate portions 31*a*, 31*c* extending each from the opposing side surface portions 30*a*, 30*c* (side surface portion in the direction of the arrow Y2 and side surface portion in the direction of the arrow Y1) of the four side surface portions 30*a*, 30*b*, 30*e*, 30*d* to cover an opening formed by the side surface portions 30*a*, 30*b*, 30*c*, 30*d*. The internal holding member 7 also includes a partitioning section 32 for partitioning the container accommodating region formed in the interior of the box body 6 into two regions, and the supporting section 33 for mounting the hemolytic agent containing container 9, the hemolytic agent containing container 10, and the stain containing container 11 at predetermined positions in the box body 6.

Figure 11:
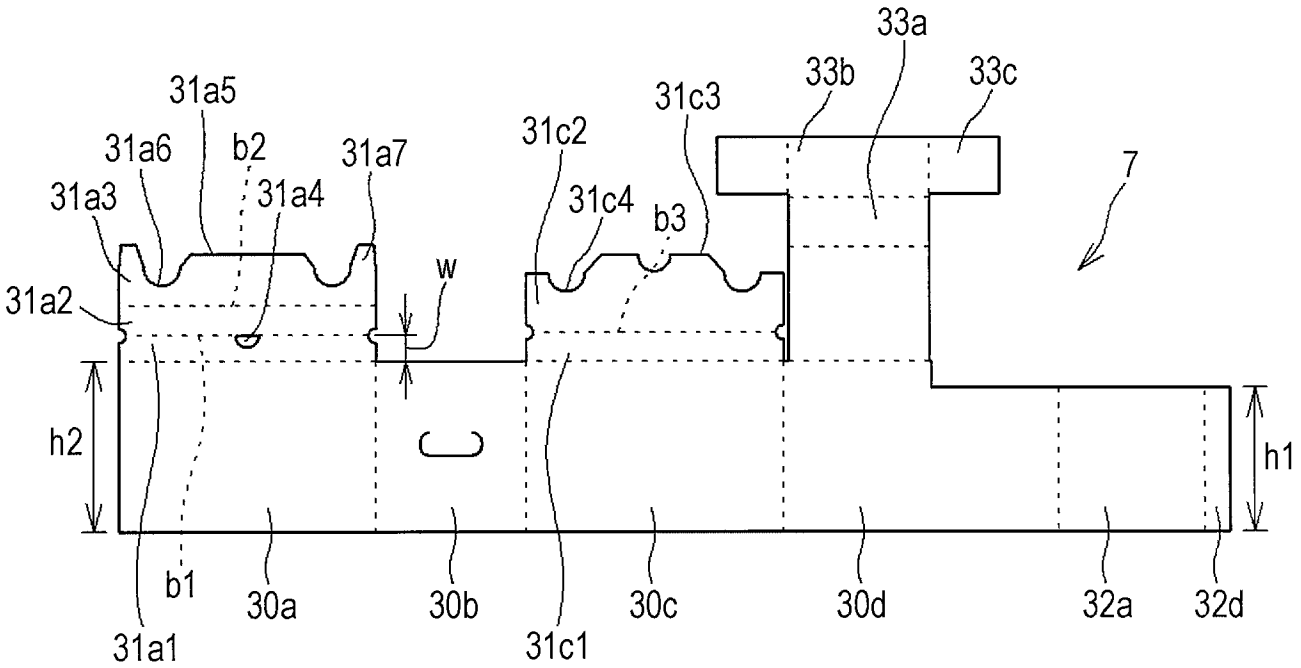
FIG. 11 is a developed diagram of the internal holding member shown in FIG. 10.

The internal holding member 7 is produced from one cardboard, as shown in FIG. 11. The internal holding member 7 can be produced by performing each process of cutting, folding, and adhering on the cardboard. The number of components can be reduced by producing with one cardboard compared to the case by producing the partitioning section 32 and the supporting section 33 as separate bodies, for example, whereby the assembly step of the reagent set can be simplified.

With reference again to FIG. 10, the top plate portion 31*c* in the direction of the arrow Y1 includes a base 31*c*1 positioned on the side surface portion 30*c* side, and an end 31*c*2 positioned on the opposite side of the side surface portion 30*c* with the base 31*c*1 in between. A central part in the X direction of the end 31*c*2 of the top plate portion 31*c* is projected out toward the distal end in a trapezoidal shape. On the other hand, the top plate portion 31*a* in the direction of the arrow Y2 includes a base 31*a*1 positioned on the side surface portion 30*a* side, an intermediate part 31*a*2 positioned on the opposite side of the side surface portion 30*a* with respect to the base 31*a*1, and an end 31*a*3 positioned on the opposite side of the base 31*a*1 with respect to the intermediate part 31*a*2. In other words, the intermediate part 31*a*2 is formed between the base 31*a*1 and the end 31*a*3 in the top plate portion 31*a*.

At the boundary of the base 31*c*1 and the end 31*c*2 of the top plate portion 31*c* is formed a folding part b3 where folding can be easily performed. In the present embodiment, the folding part b3 is formed with a slit having a broken line form. Folding parts b1, b2 where folding can be easily performed are also formed at the boundary of the base 31*a*1 and the intermediate part 31*a*2 and the boundary of the intermediate part 31*a*2 and the end 31*a*3 of the top plate portion 31*a*, respectively. In the present embodiment, the folding parts b1, b2 are formed with a slit having a broken line form. The slit may be a slit that passes through in a thickness direction of the top plate portions 31*a*, 31*c*, or may be a slit of a depth formed only on one surface of the top plate portions 31*a*, 31*c*. A semicircular opening 31*a*4 is formed near the middle of the folding part b1 of the top plate portion 31*a*. When the top plate portion 31 in a closed state is opened, the finger is inserted into the opening 31*a*4, and the circumferential edge of the opening 31*a*4 is pinched and lightly lifted up so that the boundary of the base 31*a*1 and the intermediate part 31*a*2 in a valley folded state is changed to a mountain folded state. When the cutout portions 31*a*6 and 31*c*4, to be described above, positioning the mouth portions 4*e*, 8*e* of the diluted solution container 4 and the drainage container 8 are moved toward the side surface portion 30*a*, the cutout portions 31*a*6, 31*c*4 and the mouth portions 4*e*, 8*e* can be easily disengaged.

At an edge 31*a*5 on the distal end side of the end 31*a*3 of the top plate portion 31*a* is formed a semicircular cutout portion 31*a*6, which is a positioning section for positioning the mouth portion 4*e* of the diluted solution container 4 and the mouth portion 8*e* of the drainage container 8 arranged in the container accommodating region. At an edge 31*c*3 on the distal end side of the end 31*c*2 of the top plate portion 31*c* is also formed a semicircular cutout portion 31*c*4, which is a positioning section for positioning the mouth portion 4*e* of the diluted solution container 4 and the mouth portion 8*e* of the drainage container 8 also arranged in the container accommodating region. The top plate portions 31*a*, 31*c* are closed thus covering the opening formed by the side surface portions 30*a*, 30*b*, 30*c*, 30*d*, so that the mouth portions 4*e*, 8*e* of the diluted solution container 4 and the drainage container 8 can be fixed by being sandwiched from both sides by the cutout portions 31*a*6 and 31*c*4. As a result, the diluted solution container 4 and the drainage container 8 can be stably fixed. The cutout portion 31*a*6 and the cutout portion 31*c*4 are formed at positions corresponding to the mouth portions 4*e*, 8*e* of the diluted solution container 4 and the drainage container 8 arranged in the container accommodating region.

A semicircular cutout c is formed at each edge in the direction of the arrow X1 and the direction of the arrow X2 of the top plate portions 31*a*, 31*c*. Such cutout c has a size to the extent in which the finger of the user can be inserted, and is configured to enable the user to hold the edges of the top plate portions 31*a*, 31*c* when closing and opening the top plate portions 31*a*, 31*c*. The opening/closing task of the top plate portions 31*a*, 31*c* thus can be smoothly carried out.

Similar to the cutout portion 31*c*4, a semicircular cutout C is formed at the middle of the edge 31*c* of the top plate portion 31*c*. The edge of the cutout C is pinched with fingers to shift the top plate portion 31*c* toward the side surface portion 30*c* with the top plate portions 31*a*, 31*c* closed, so that the cutout portion 31*c*4 of the top plate portion 31*c* and the mouth portions 4*e*, 8*e* of the diluted solution container 4 and the drainage container 8 can be easily disengaged.

An extended portion 31*a*7 extended in the distal end direction is formed at the edge in the direction of the arrow X1 and the edge in the direction of the arrow X2 of the end 31*a*3 of the top plate portion 31*a*. With the arrangement of such extended portion 31*a*7, the positioning of the mouth portions 4*e*, 8*e* of the diluted solution container 4 and the drainage container can be more reliably carried out.

The supporting section 33 includes a mounting surface 33*a*, on which three bottle-shaped containers such as the hemolytic agent containing container 9 are mounted, and leg portions 33*b*, 33*c* for arranging the mounting surface 33*a* at a predetermined height from the bottom portion 21 of the box body 6. As shown in FIG. 11, the supporting section 33 in the present embodiment is integrated with the side surface portion 30*d*.

The partitioning section 32 includes a partitioning wall 32*a* arranged at substantially the central part of the container accommodating region to partition the container accommodating region into two regions, a region where the diluted solution container 4 is to be arranged and a region where the drainage container 8 is to be arranged, and a fixing portion 32*b* arranged on the distal end side of the partitioning wall 32*a*. The fixing portion 32*b* is securely attached to the inner peripheral surface of the side surface portion 30*c* by an adhesive. As shown in FIG. 11, the partitioning section 32 is formed integrally with the side surface portion 30*d*.

A height h1 of the partitioning wall 32*a* is set to be lower than a height h2 of the side surface portions 30*a* to 30*d* by substantially a width w of the bases 31*a*1, 31*c*1 of the top plate portions 31*a*, 31*c*. As a result, the height of the partitioning section 32 becomes substantially the same height as the lower ends of the mouth portions 4*e*, 8*e* of the diluted solution container 4 and the drainage container 8 arranged in the container accommodating region. Thus, the lower surface (surface positioned on the interior side of the box body) of the ends 31*a*3, 31*c*2 of the top plate portions 31*a*, 31*c* can be brought into contact with an upper end edge 32*a*1 of the partitioning wall 32*a* with the cutout portions 31*a*6, 31*c*4 of the top plate portions 31*a*, 31*c* engaged with the mouth portions 4*e*, 8*e* of the diluted solution container 4 and the drainage container 8. As a result, even if the diluted solution container 4 and the drainage container 8 move during transportation of the reagent set 1, and the like, and the mouth portions 4*e*, 8*e* of the diluted solution container 4 and the drainage container 8 shift toward the lower side, the movement toward the lower side of the top plate portions 31*a*, 31*c* is restrained and the fixed state of the diluted solution container 4 and the drainage container 8 by the cutout portions 31*a*6, 31*c*4 of the top plate portions 31*a*, 31*c* can be maintained.

[Assembly Method of Reagent Set]

The reagent set 1 is assembled, for example, in the following manner.

First, the bottom portion 21 is closed, and the box body 6 with the lid portion 22 opened is prepared. Such a box body 6 can be obtained through a normal production method using a cardboard.

Figure 12:
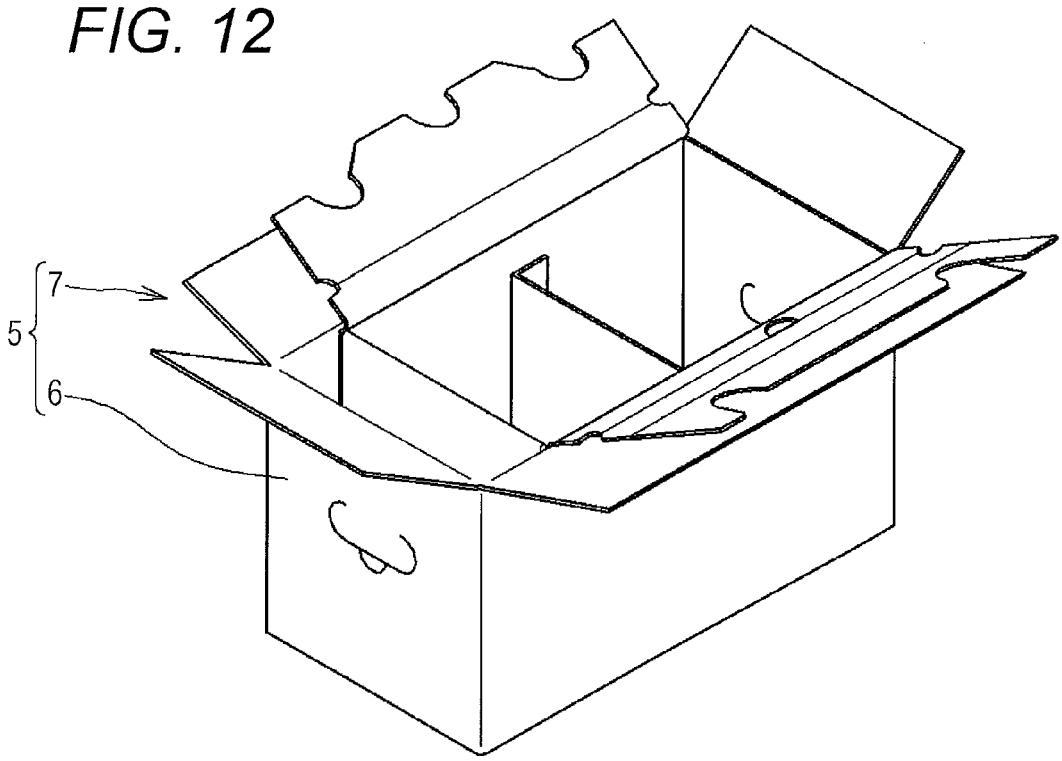
FIG. 12 is a perspective explanatory view showing a state in which the internal holding member is arranged in the box body.

Next, the internal holding member 7 is inserted into the box body 6, as shown in FIG. 12.

Thereafter, a predetermined amount of air is injected into the diluted solution container 4 and the drainage container 8, which are in the folded state, to obtain an inflated state, and then the mouth portions 4*e*, 8*e* of the diluted solution container 4 and the drainage container 8 are closed by screw-fitting the caps 4*f*, 8*f* thereon.

Figure 13:
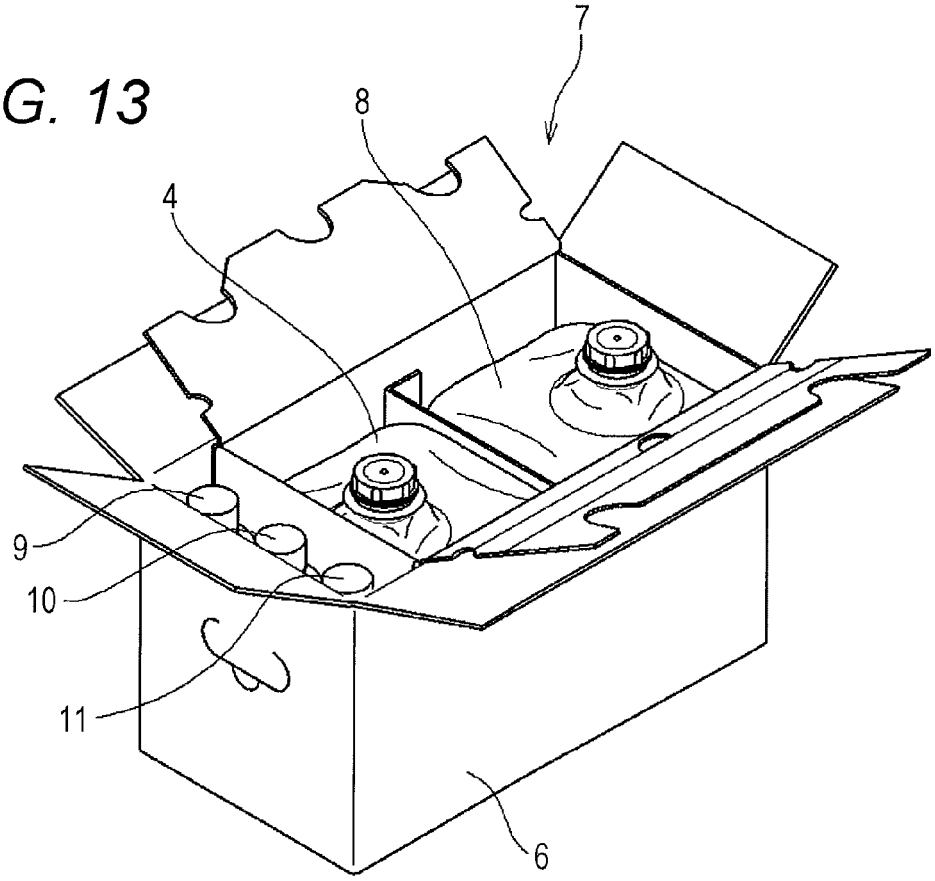
FIG. 13 is a perspective explanatory view showing a state in which a diluted solution container and drainage container inflated by being supplied with air are arranged in the container accommodating region formed in the box body.

Next, as shown in FIG. 13, the closed diluted solution container 4 and the drainage container 8 are arranged in each region in the container accommodating region partitioned by the partitioning section 32. In the present embodiment, the drainage container 8 is arranged in the region in the direction of the arrow X2 and the diluted solution container 4 is arranged in the region in the direction of the arrow X1 in the container accommodating region. Thus, the diluted solution container 4 and the drainage container 8 are respectively arranged with the partitioning wall 32*a* of the partitioning section 32 in between.

The box body 6 in which the top plate portions 31*a*, 31*c* of the internal holding member 7 are opened, that is, in which the opening formed by the side surface portions 30*a*, 30*b*, 30*c*, 30*d* of the internal holding member 7 is not covered by the top plate portions 31*a*, 31*c* is set at a predetermined position of an automatic dispenser. The automatic dispenser holds a brim-shaped lock portion 4*d* of the diluted solution container 4. The automatic dispenser removes the cap 4*f* screw-fitted to the mouth portion 4*e*. The automatic dispenser dispenses a predetermined amount of diluted solution into the main body 4*a*. The automatic dispenser screw-fits the cap 4*f* to the mouth portion 4*e* after the completion of dispensing.

The hemolytic agent containing container 9, the hemolytic agent containing container 10, and the stain containing container 11 in which a predetermined fluid is contained in each container, and sealed with the caps 9*c*, 10*c*, 11*c* are arranged on the mounting surface 33*a* of the supporting section 33 of the internal holding member 7. The hemolytic agent containing container 9, the hemolytic agent containing container 10, and the stain containing container 11 are arranged in such order on the mounting surface 33*a* from the direction of the arrow Y1 toward the direction of the arrow Y2.

Figure 14:
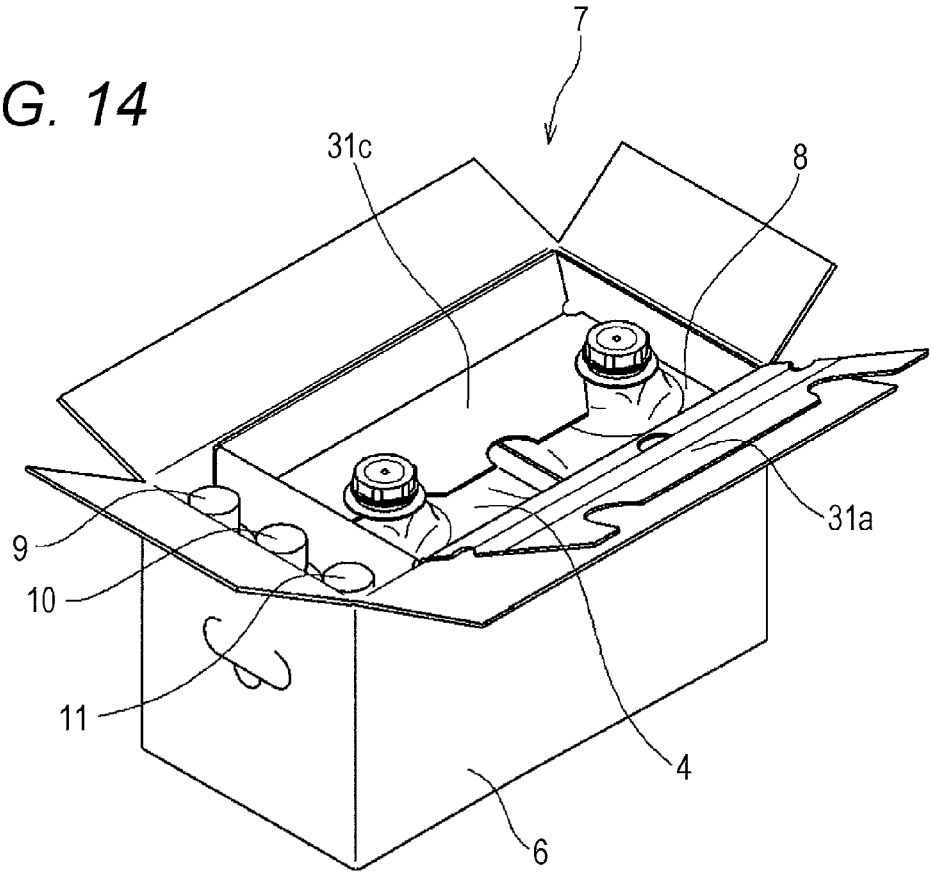
FIG. 14 is a perspective explanatory view showing a state in which one top plate portion is attached to the mouth portion of the container.

As shown in FIG. 14, the cutout portion 31*c*4 of the top plate portion 31*c* that does not include the intermediate part is then engaged with the mouth portions 4*e*, 8*e* of the diluted solution container 4 and the drainage container 8. More specifically, the folding part b3 of the top plate portion 31*c* is folded to a valley folded state, and the cutout portion 31*c*4 of the top plate portion 31*c* is arranged on the lower side of the lock portions 4*d*, 8*d* of the diluted solution container 4 and the drainage container 8 in such a state.

Figure 15:
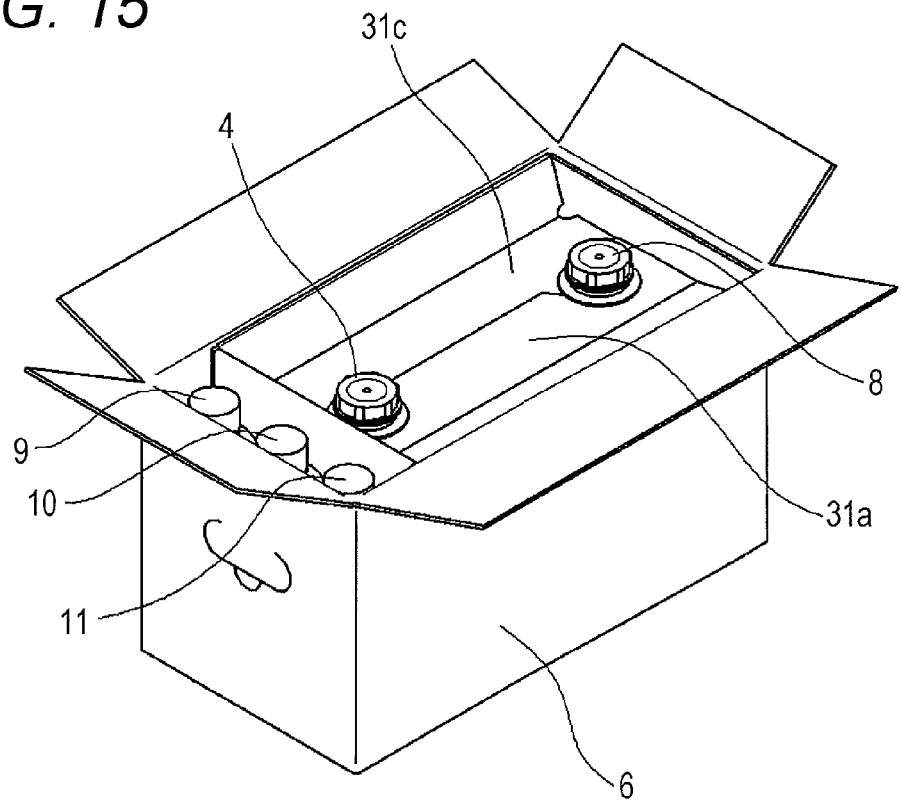
FIG. 15 is a perspective explanatory view showing a state in which another top plate portion is attached to the mouth portion of the container.
Figure 16A:
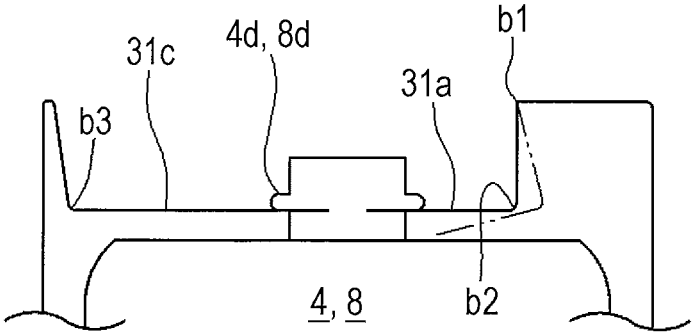
FIGS. 16A and 16B are views describing a procedure of attaching the top plate portion to the mouth portion of the container.
Figure 16B:
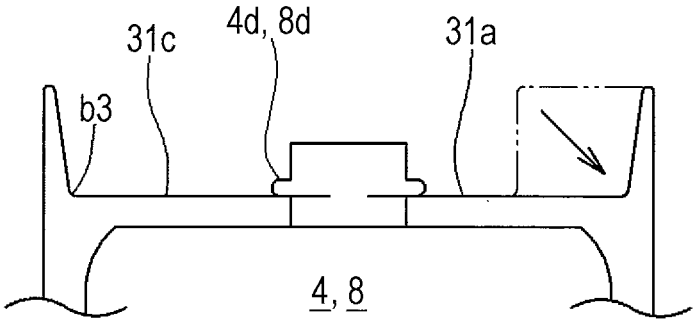

As shown in FIG. 15, the cutout portion 31*a*6 of the top plate portion 31*a* including the intermediate part is engaged with the mouth portions 4*e*, 8*e* of the diluted solution container 4 and the drainage container 8. More specifically, the folding part b1 of the top plate portion 31*a* is folded to a mountain folded state and the folding part b2 is folded to a valley folded state, so that the cutout portion 31*a*6 of the top plate portion 31*a* is arranged on the lower side of the lock portions 4*d*, 8*d* of the diluted solution container 4 and the drainage container 8 in such a state (see FIG. 16A). Thereafter, as shown in FIG. 16B, the folding part 1*l* in the mountain folded state is pushed in toward the inner side to be in a valley folded state. Thus, the end of the top plate portion 31*a* moves toward the mouth portions 4*e*, 8*e* of the diluted solution container 4 and the drainage container 8, whereby the mouth portions 4*e*, 8*e* of the diluted solution container 4 and the drainage container 8 can be held as if being pushed by the cutout portion 31*a*6 of the top plate portion 31*a*. Thus, the opening formed by the side surface portions 30*a*, 30*b*, 30*c*, 30*d* of the internal holding member 7 is covered by a pair of top plate portions 31*a*, 31*c*.

In the present embodiment, the boundary of the side surface portion 30*a* and the base 31*a*1, and the boundary of the side surface portion 30*c* and the base 31*c*1 are both folded to the valley folded state to hold the mouth portions 4*e*, 8*e* of the diluted solution container 4 and the drainage container 8. The mouth portions 4*e*, 8*e* thus can be reliably positioned.

The second lid portion pieces 22*b*, 22*d* of the box body 6 are then folded toward the inner side, and thereafter, the first lid portion pieces 22*a*, 22*c* of the box body 6 are folded toward the inner side to close the lid portion 22 of the box body 6, and then the closed state of the lid portion 22 is maintained with the adhesive, the adhesive tape, and the like.

The assembly of the reagent set 1 of the present embodiment is completed through the above steps.

[Usage Method of Reagent Set]

Before describing the usage method of the reagent set 1 described above, the reagent take-out member 3 that is used when using the reagent set 1 will be described.

[Reagent Take-Out Member]

As shown in FIG. 1, the reagent take-out member 3 is arranged to cover the upper opening of the boxy 6 before using the reagent set 1. As shown in FIG. 7, the reagent take-out member 3 is formed with the reagent take-out portions 3*a*, 3*b*, 3*c*, and 3*d* so as to correspond to the hemolytic agent containing container 9, the hemolytic agent containing container 10, the stain containing container 11, and the diluted solution container 4. A drainage discharging portion 3*e* is formed to correspond to the drainage container 8.

The reagent take-out portions 3*a*, 3*b*, 3*c*, and 3*d* respectively include the reagent aspirating tubes 3*f*, 3*g*, 3*h*, and 3*i* for aspirating the reagent. The drainage discharging portion 3*e* includes a drainage discharging tube 3*j* for discharging the reagent. As shown in FIG. 7, the reagent take-out portions 3*a*, 3*b*, 3*c*, and 3*d* as well as the drainage discharging portion 3*e* are fixed to a metal plate 3*k*. The reagent take-out portions 3*a*, 3*b*, 3*c*, and 3*d* as well as the drainage discharging portion 3*e* are thereby fixed and held such that the positions do not change with respect to each other.

As shown in FIG. 1, the reagent take-out portions 3*a*, 3*b*, 3*c*, and 3*d*, as well as the drainage discharging portion 3*e* are each connected to a suction port 2*a*, 2*b*, 2*c*, 2*d*, and 2*e* of the sample analyzer through the tubes 15*a*, 15*b*, 15*c*, 15*d*, and 15*e*, and are arranged in the box body 6 while maintaining the connected state.

[Usage Procedure]

When carrying the reagent set 1, the user pushes the cutoff piece 24 arranged at the side surface portions 20*b* and 20*d* of the box body 6 toward the interior of the box body 6, and carries the reagent set 1 (box body 6) while supporting the handgrip section 25, which is formed by spreading the handgrip forming section 23 toward the outer side, from both sides in the X direction.

Figure 3:
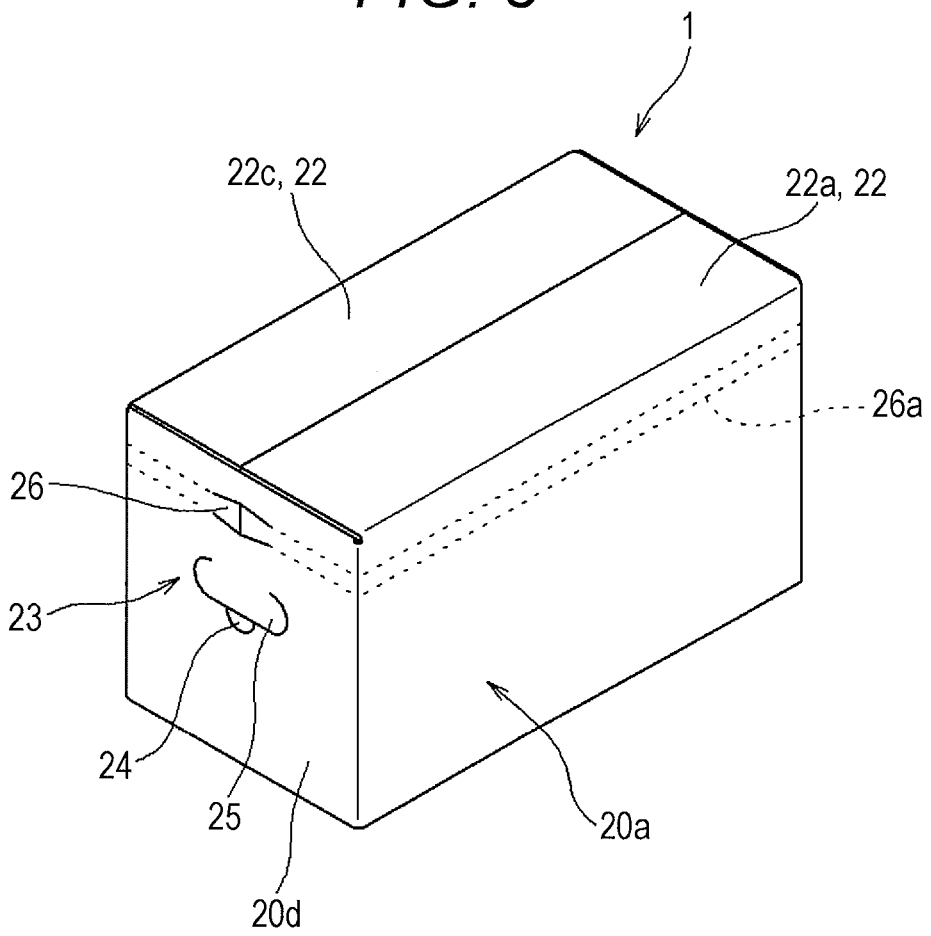
FIG. 3 is a perspective view showing an outer appearance of a state in which a lid portion of the reagent set shown in FIG. 1 is closed.
Figure 4:
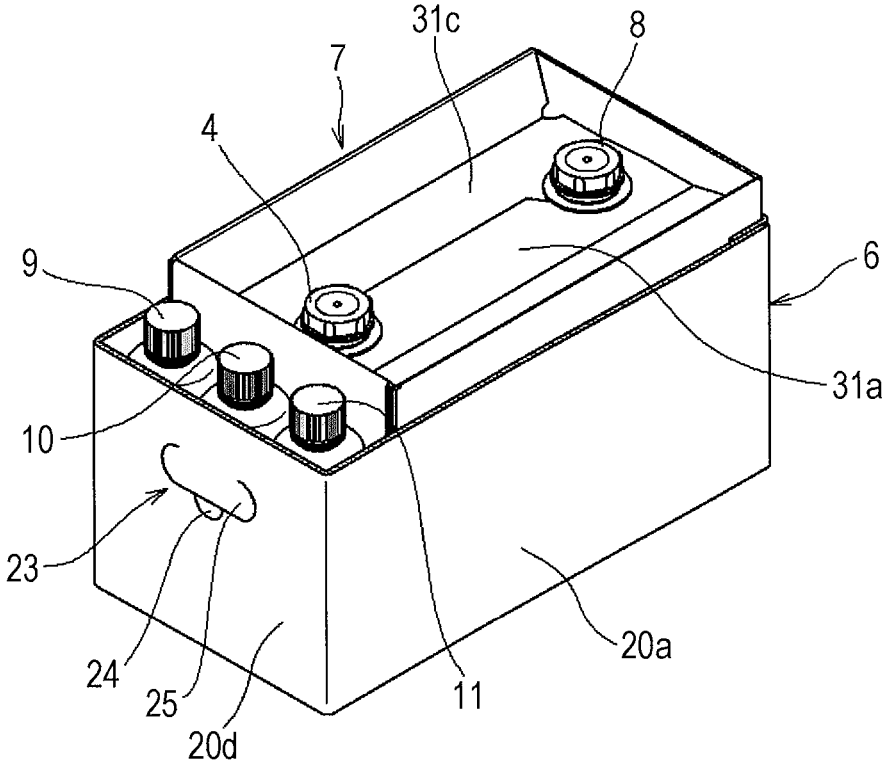
FIG. 4 is a perspective explanatory view showing an outer appearance in which the lid portion of the reagent set shown in FIG. 1 is cut off.
Figure 5:
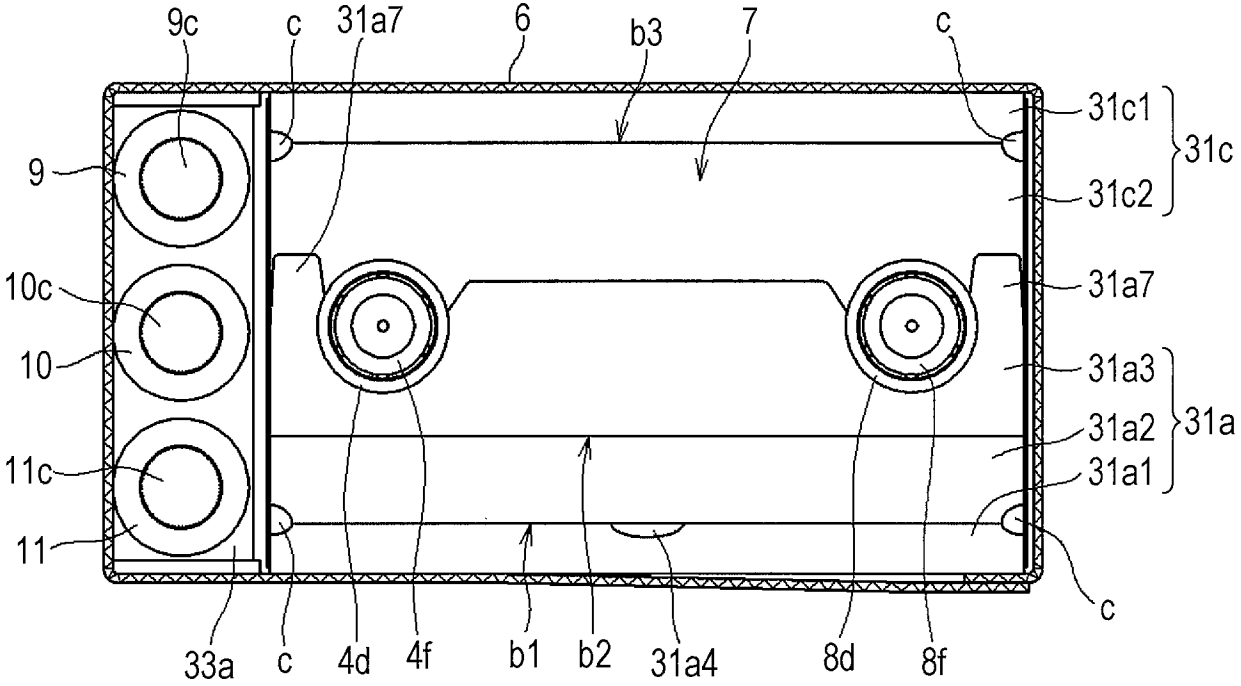
FIG. 5 is a plan view of a state in which the lid portion of the reagent set shown in FIG. 1 is cut off.

On use of the reagent set 1, the state shown in FIG. 3 becomes the state shown in FIG. 4 in which the lid portion 22 is cut off. In this case, the pinching section 26 arranged at the side surface portion is pulled out to the outer side. As shown in FIGS. 2 and 10, one end of a tear tape 26*a* securely attached to the inner peripheral surface of the box body 6 is fixed to the pinching section 26 so as to substantially make one round along the box body 6. The pulled out pinching section 26 is pulled, so that the side surface portion of the box body 6 is cut along the tear tape 26*a* and the lid portion 22 is cut off.

In the present embodiment, the secure attachment position of the tear tape (secure attachment position in the up and down direction on the inner peripheral surface of the box body) is set such that the upper end position of the box body 6 in which the lid portion 22 is cut off becomes lower than the upper position of the internal holding member 7 arranged in the box body 6. Thus, the boundary portion in the mountain folded state of the side surface portion 30*c* and the base 31*c*1, and the boundary portion of the mountain folded state of the side surface portion 30*a* and the base 31*a*1 in upward projecting states are used to easily and reliably arrange the reagent take-out member 5 in the box body 6.

Then, the caps 4*f*, 8*f* screw-fitted to the mouth portions 4*e*, 8*e* of the diluted solution container 4 and the drainage container 8 are detached, and the user arranges the reagent take-out member 3 to cover the upper opening of the box body 6 in which the lid portion 22 is cut off. In this case, each reagent aspirating tube 3*f*, 3*g*, 3*h*, and 3*i* is inserted to the corresponding reagent containers 9, 10, 11 and the mouth portion of the diluted solution container 4, and the drainage discharging tube 3*j* of the drainage discharging portion 3*e* is inserted to the mouth portion 8*e* of the drainage container 8.

The user then operates the sample analyzer 2, and the reagent contained in the hemolytic agent containing container 9, the hemolytic agent containing container 10, and the stain containing container 11, and the reagent contained in the diluted solution container 4 are sent to the sample analyzer 2 through the reagent aspirating tubes 3*f*, 3*g*, 3*h*, and 3*i*, and the tubes 15*a*, 15*b*, 15*c*, and 15*d*, respectively, as shown in FIG. 1. The reagent after being used for the analysis of the sample is collected as the drainage in the drainage container 8 through the tube 15*e* and the drainage discharging portion 3*e*.

When the remains of the reagent contained in the hemolytic agent containing container 9, the hemolytic agent containing container 10, and the stain containing container 11 or the diluted solution contained in the diluted solution container 4 become scarce as a result of performing the analysis of the sample over a predetermined number of times in the sample analyzer 2, a message instructing the change of the reagent set 1 is displayed on a display unit (not shown) of the sample analyzer 2, and the use of the reagent set 1 is terminated.

The used reagent set 1 is stored in a predetermined place, and either the entire reagent set 1 is discarded or only the drainage collected in the drainage container 8 is discarded separate from the other box body, and the like.

As described above, the reagent set 1 according to the present embodiment includes the box body 6, the internal holding member 7 arranged in the box body 6 to form the container accommodating region in the box body 6, and the diluted solution container 4 and the drainage container 8 arranged in the container accommodating region. The internal holding member 7 includes a plurality of side surface portions 30*a*, 30*b*, 30*c*, 30*d*, and a pair of top plate portions 31*a*, 31*c* respectively extending from the opposing side surface portions 30*a*, 30*c* to cover an opening formed by the side surface portions 30*a*, 30*b*, 30*c*, 30*d*. Each of the pair of top plate portions 31*a*, 31*c* is formed, at the end, with a cutout portion 31*a*6, 31*c*4 for positioning the mouth portion 4*e* of the diluted solution container 4 and the mouth portion 8*e* of the drainage container 8, where the mouth portions 4*e*, 8*e* of the diluted solution container 4 and the drainage container 8 arranged in the container accommodating region are positioned by the cutout portions 31*a*6, 31*c*4 when the opening formed by the side surface portions 30*a*, 30*b*, 30*c*, 30*d* is covered with the pair of top plate portions 31*a*, 31*c*.

Therefore, the mouth portions 4*e*, 8*e* of the diluted solution container 4 and the drainage container 8 arranged in the container accommodating region are positioned by covering the opening formed by the side surface portions 30*a*, 30*b*, 30*c*, 30*d* with the pair of top plate portions 31*a*, 31*c*, whereby the container packaging task is facilitated, and the mouth portions 4*e*, 8*e* of the diluted solution container 4 and the drainage container 8 can be stably positioned. In a state where the internal holding member 7 is set in the box body 6, a state in which the opening formed by the side surface portions 30*a*, 30*b*, 30*c*, 30*d* is not covered by the top plate portions 31*a*, 31*c* can be obtained, so that the top plate portions 31*a*, 31*c* do not get in the way when a reagent filling nozzle of an automatic filler is fixed and connected to the mouth portion 4*e* of the diluted solution container 4. Therefore, the automatic filling of the reagent with respect to the diluted solution container 4 and the drainage container 8 arranged in the container accommodating region can be carried out. As a result, the filling efficiency of the reagent can be enhanced.

In the present embodiment, the cutout portions 31*a*6, 31*c*4 fix the mouth portion 4*e* of the diluted solution container 4 and the mouth portion 8*e* of the drainage container 8 by sandwiching from both sides. Thus, the mouth portions 4*e*, 8*e* of the diluted solution container 4 and the drainage container 8 can be more reliably and stably positioned.

In the present embodiment, the brim-shaped lock portions 4*d*, 8*d* are arranged on the mouth portion 4*e* of the diluted solution container 4 and the mouth portion 8*e* of the drainage container 8, respectively, and the cutout portions 31*a*6, 31*c*4 of the pair of top plate portions 31*a*, 31*c* fix and sandwich the lower side of the lock portions 4*d*, 8*d*. The mouth portions 4*e*, 8*e* of the diluted solution container 4 and the drainage container 8 can be further reliably and stably positioned.

In the present embodiment, the internal holding member 7 includes the partitioning section 32 for partitioning the container accommodating region into two regions. Thus, the positioning of the diluted solution container 4 and the drainage container 8 can be accurately carried out, and the diluted solution container 4 and the drainage container 8 can be reliably fixed.

In the present embodiment, the partitioning section 32 is integrally molded with the side surface portion 30*d*. Thus, the number of components can be reduced compared to the case where the partitioning section 32 and the side surface portion 30*d* are produced as separate bodies, whereby the assembly step of the reagent set 1 can be simplified.

In the present embodiment, the height of the partitioning section 32 is substantially the same height as the lower ends of the mouth portions 4*e*, 8*e* of the diluted solution container 4 and the drainage container 8 arranged in the container accommodating region. Therefore, even if the diluted solution container 4 and the drainage container 8 move when the reagent set 1 is transported and the like, and the mouth portions 4*e*, 8*e* of the diluted solution container 4 and the drainage container 8 shift toward the lower side, the movement of the top plate portions 31*a*, 31*c* toward the lower side is restrained, and the fixed state of the diluted solution container 4 and the drainage container 8 by the cutout portions 31*a*6, 31*c*4 of the top plate portions 31*a*, 31*c* can be maintained.

In the present embodiment, the top plate portions 31*a*, 31*c* are respectively formed with the folding parts b1, b3 of the valley folded state at the positions of making contact with the opposing side surface portions 30*a*, 30*c* in a state where the top plate portions 31*a*, 31*c* are positioning the mouth portions 4*e*, 8*e* of the diluted solution container 4 and the drainage container 8. Thus, the cutout portions 31*a*6, 31*c*4 of the top plate portions 31*a*, 31*c* are pushed toward the mouth portions 4*e*, 8*e* with a biasing force obtained by the valley folded state, thus reliably positioning the mouth portions 4*e*, 8*e*.

In the present embodiment, the top plate portion 31*a* is formed in order with the folding part b1 in the mountain folded state and the folding part b2 in the valley folded state in a direction away from the side surface portion 30*a* at a position distant from the opposing side surface portion 30*a*. In a state where the top plate portion 31*a* is positioning the mouth portions 4*e*, 8*e* of the diluted solution container 4 and the drainage container 8, the folding part b1 in the valley folded state is formed at a position of making contact with the side surface portion 30*a* by applying an external force on the folding part b1 in the mountain folded state. Thus, when the folding part b1 in the mountain folded state is changed to the folding part b1 in the valley folded state, the cutout portion 31*a*6 of the top plate portion 31*a* is pushed toward the mouth portions 4*e*, 8*e* with the obtained biasing force, so that the mouth portions 4*e*, 8*e* can be reliably positioned. When the folding part b1 is in the mountain folded state, the cutout portion 31*a*6 of the top plate portion 31*a* can be easily moved and thus the cutout portion 31*a*6 can be easily set in the mouth portions 4*e*, 8*e*.

In the present embodiment, the folding part b1 is entirely in the valley folded state in a state where the top plate portion 31*a* is positioning the mouth portions 4*e*, 8*e* of the diluted solution container 4 and the drainage container 8, but such embodiment is not the sole case. For example, the folding part b1 in the valley folded state may be partially formed at a position of making contact with the side surface portion 30*a* by applying an external force on one part of the folding part b1 in the mountain folded state. According to such configuration as well, the mouth portions 4*e*, 8*e* of the diluted solution container 4 and the drainage container 8 can be reliably positioned.

In the present embodiment, a cutout c is for holding the top plate portions 31*a*, 31*c* is formed at the peripheral edge of the top plate portions 31*a*, 31*c*. The opening/closing task of the top plate portions 31*a*, 31*c* thus can be smoothly carried out.

In the present embodiment, a tear tape that enables the lid portion 22 of the box body 6 to be cut off is attached to the side surface of the box body 6 so as to substantially make one round along the inner peripheral surface of the box body. The lid portion 22 of the box body 6 thus can be easily cut off.

In the present embodiment, the upper end position of the box body 6, which lid portion 22 is cut off, is lower than the upper end position of the internal holding member 7. Thus, the arrangement of the reagent take-out member 5 to the box body 6 can be easily and reliably carried out.

In the present embodiment, the box body 6 has a cube shape or a cuboid shape including four side surface portions 20*a*, 20*b*, 20*c*, 20*d*, the bottom portion 21, and the lid portion 22, the lid portion 22 being configured by the pair of first lid portion pieces 22*a*, 22*c* respectively extending from one opposing side surface portions 20*a*, 20*c* and the pair of second lid portion pieces 22*b*, 22*d* respectively extending from the other opposing side surface portions 20*b*, 20*d*. Thus, when the lid portion 22 is closed, the strength of the box body 6 can be enhanced.

OTHER VARIANTS

The embodiments disclosed herein are merely illustrative in all aspects and should not be construed as being exclusive. The scope of the present invention is defined by the claims rather than by the description made above, and is intended to include meanings equivalent with the claims and all modifications within the scope of the invention.

For example, in the embodiments described above, the container accommodating region is partitioned into two regions by the partitioning section 23, but may not be partitioned or may be partitioned into three or more regions.

In the embodiments described above, the number of reagent containers positioned by the cutout portions 31*a*6, 31*c*4 is one (diluted solution container 4) but may be two or more.

In the embodiments described above, the semicircular cutout portions 31*a*6, 31*c*4 are adopted for the positioning sections, but a rectangular or a polygonal cutout portions other than the semicircular shape may be adopted.

In the embodiment described above, the tear tape 26*a* attached to the inner peripheral surface of the box body 6 is used as a tearing means for cutting off the lid portion of the box body 6, but such an embodiment is not the sole case, and a known means enabling the lid portion of the box body 6 to be cut off may be appropriately adopted.

For example, instead of the tear tape 26*a*, a string to be attached to the inner peripheral surface of the box body 6 may be used, or a slit of a broken-line form may be formed on the peripheral surface of the box body 6 and the lid portion may be cut off along such a slit.

What is claimed is:

1. A reagent set comprising:

a box body;

an internal holding member arranged in the box body to form a container accommodating region in the box body; and a reagent container, arranged in the container accommodating region, and including a main body portion and a mouth portion formed so as to protrude from an upper surface of the main body portion, wherein the internal holding member includes a first side surface portion, a second side surface portion opposing the first side surface portion, a first top plate portion extending from the first side surface portion and including a first cutout portion formed at an end of the first top plate portion that is disposed at least partially over the upper surface of the main body portion, and a second top plate portion extending from the second side surface portion and including a second cutout portion formed at an end of the second top plate portion that is disposed at least partially over the upper surface of the main body portion, wherein the first cutout portion and the second cutout portion engage the mouth portion of the reagent container on opposite sides thereof so as to form a positioning section for positioning the mouth portion of the reagent container.

2. The reagent set according to claim 1, wherein the positioning section fixes the mouth portion of the reagent container by sandwiching from both sides with the first cutout portion and the second cutout portion.

3. The reagent set according to claim 2, wherein the reagent container has a brim-shaped lock portion on a lower side of the mouth portion; and the positioning section fixes the mouth portion by sandwiching a lower side of the lock portion.

4. The reagent set according to claim 1, further comprising:

another reagent container different from the reagent container; wherein the reagent container and said another reagent container are arranged in the container accommodating region.

5. The reagent set according to claim 1, wherein the internal holding member further includes a partitioning section for partitioning the container accommodating region into a plurality of regions.

6. The reagent set according to claim 5, wherein the partitioning section is formed integrally with the first side surface portion.

7. The reagent set according to claim 5, wherein a height of the partitioning section is substantially the same height as a lower end of the mouth portion of the reagent container arranged in the container accommodating region.

8. The reagent set according to claim 1, wherein the first top plate portion includes a first valley folded part at a position of making contact with the first side surface portion in a state of forming the positioning section; and the second top plate portion includes a second valley folded part at a position of making contact with the second side surface portion in a state of forming the positioning section.

9. The reagent set according to claim 1, wherein the first top plate portion includes a first mountain folded part and a first valley folded part in order in a direction away from the first side surface portion at positions distant from the first side surface portion;

the second top plate portion includes a second mountain folded part and a second valley folded part in order in a direction away from the second side surface portion at positions distant from the second side surface portion; and the first and second valley folded parts are formed at positions of making contact with the first and second side surface portions when an external force is applied on the first and second mountain folded parts in a state of forming the positioning section.

10. The reagent set according to claim 9, wherein a part of the first and second mountain folded parts are configured to become valley folded parts at positions of making contact with the first and second side surface portions by applying an external force.

11. The reagent set according to claim 1, wherein a third cutout portion for gripping the first top plate portion is formed at a peripheral edge of the first top plate portion.

12. The reagent set according to claim 1, wherein a tearing means enabling a lid portion of the box body to be cut off is arranged on a side surface of the box body so as to make substantially one round along the box body.

13. The reagent set according to claim 12, wherein the tearing means includes a tear tape attached to an inner peripheral surface of the box body.

14. The reagent set according to claim 12, wherein an upper end position of the box body, in which the lid portion is cut off, is lower than an upper end position of the internal holding member.

15. The reagent set according to claim 1, wherein the box body has a cube shape or a cuboid shape including four side surface portions, a bottom portion, and a lid portion; and the lid portion is configured by a pair of first lid portion pieces respectively extending from one opposing side surface portions, and a pair of second lid portion pieces respectively extending from the other opposing side surface portions.

16. The reagent set according to claim 1, wherein the internal holding member further includes, a third side surface portion, and a fourth side surface portion; and the first to fourth side surface portions are arranged to form a square shape or a rectangular shape when seen from an upper side.

17. A reagent container packing box comprising:

a box body; and an internal holding member arranged in the box body to form a container accommodating region in the box body, wherein the internal holding member includes a first side surface portion, a second side surface portion opposing the first side surface portion, a first top plate portion extending from the first side surface portion and including a first cutout portion formed at an end of the first top plate portion that is disposed at least partially over an upper surface of a main body portion of a reagent container arranged in the container accommodating region, and a second top plate portion extending from the second side surface portion and including a second cutout portion formed at an end of the second top plate portion that is disposed at least partially over the upper surface of the main body portion, wherein the first cutout portion and the second cutout portion engage the mouth portion of the reagent container on opposite sides thereof so as to form a positioning section for positioning a mouth portion of the reagent container.

18. The reagent container packing box according to claim 17, wherein the internal holding member further includes a partitioning section for partitioning the container accommodating region into a plurality of regions.

19. The reagent container packing box according to claim 17, wherein the internal holding member further includes, a third side surface portion, and a fourth side surface portion; and the first to fourth side surface portions are arranged to form a square shape or a rectangular shape when seen from an upper side.

20. A reagent set comprising:

a box body;

an internal holding member arranged in the box body to form a container accommodating region in the box body; and a reagent container, arranged in the container accommodating region, and including a main body portion and a mouth portion formed so as to protrude from an upper surface of the main body portion, wherein the internal holding member includes a first side surface portion, a second side surface portion opposing the first side surface portion, a first top plate portion extending from the first side surface portion and including a first cutout portion formed at an end of the first top plate portion that is disposed at least partially over the upper surface of the main body portion, and a second top plate portion extending from the second side surface portion and including a second cutout portion and a third cutout portion both formed at an end of the second top plate portion that is disposed at least partially over the upper surface of the main body portion, wherein the first cutout portion and the second cutout portion form a positioning section configured to position the mouth portion of the reagent container, and wherein the third cutout portion is configured to allow a user's finger to be directed into the third cutout portion to pinch an edge thereof to thereby facilitate movement of the second top plate portion toward the second side surface portion.

21. The reagent set according to claim 1, wherein the end of the first top plate is opposite the first side surface portion and the end of the second top plate portion is opposite the second side surface portion and at least partially overlaps the end of the first top plate.

22. The reagent container packing box according to claim 17, wherein the positioning section fixes a mouth portion of the reagent container by sandwiching from both sides with the first cutout portion and the second cutout portion.

23. The reagent set according to claim 20, wherein the end of the first top plate is opposite the first side surface portion and the end of the second top plate portion is opposite the second side surface portion and at least partially overlaps the end of the first top plate.

* * * * *